United States Patent [19]

Laporte et al.

[11] 4,300,520

[45] Nov. 17, 1981

[54] TARGET THROWING DEVICE

[76] Inventors: Jean Michel Laporte, Villa des Marches 201 route de Lamer; Jean Claude Laporte, 7, rue des Bachettes, both of 06410 Biot, France

[21] Appl. No.: 58,351

[22] Filed: Jul. 17, 1979

[30] Foreign Application Priority Data

Jul. 18, 1978 [FR] France ..... 78 22190

[51] Int. Cl.[3] ..... F41B 3/04

[52] U.S. Cl. ..... 124/9

[58] Field of Search ..... 124/9, 8, 6, 43, 42, 124/36, 40; 74/52, 70, 112

[56] References Cited

U.S. PATENT DOCUMENTS

| | | | |
|---|---|---|---|
| 956,822 | 5/1910 | Parsons | 74/70 X |
| 2,063,284 | 12/1936 | Winans . | |
| 2,666,424 | 1/1954 | Foster | 124/9 |
| 3,225,754 | 12/1965 | Foster . | |
| 3,937,204 | 2/1976 | Alday et al. | 124/9 |
| 4,077,384 | 3/1978 | Montefeltro . | |

FOREIGN PATENT DOCUMENTS 1125504 7/1956 France .

*Primary Examiner*—Richard C. Pinkham
*Assistant Examiner*—William R. Browne
*Attorney, Agent, or Firm*—Schwartz, Jeffery, Schwaab, Mack, Blumenthal & Koch

[57] ABSTRACT

A target throwing device having a base and a support rotatably mounted on the basis for swinging movement about an upright axis. A throwing arm is rotatably mounted on the support for throwing targets. Structure is provided for eccentrically swinging the support back and forth while throwing targets. A mechanism is connected within a first eccentric drive connection and is operative in response to movement of the first eccentric drive for superimposing an eccentric series of short back and forth swings on the support during each long swing of the support. A second eccentric drive transmits eccentric motion to the support through a member that is movable with respect to the guide mechanism.

8 Claims, 5 Drawing Figures

TARGET THROWING DEVICE

This invention is directed toward an improved target throwing device for use in target shooting.

Devices for throwing targets in order to practice, or compete in shooting are well known. The devices usualy employ a mechanically actuated arm to fling targets, one at a time, into the air to very generally simulate the rising flight of a game bird. In order to provide some unpredictability in the flight of the targets, it is also known to swing the device, or more particularly, the throwing arm, back and forth through an arc while continuing to operate the arm. Thus the targets are flung out in various directions.

However, even the back and forth swinging motion has a certain predictability to it and shooters can anticipate the directions the targets will be thrown.

It is the purpose of the present invention to provide a target throwing device which makes it more difficult to predict or anticipate the target throwing direction, thus making for better shooting.

It is another purpose to provide a target throwing device with a mechanism for throwing out targets in unpredictable fashion which mechanism is very simple in construction and operation.

In accordance with the present invention a target throwing device is provided that not only swings the throwing arm back and forth while continuing to throw targets, but during each long swing of the arm in one direction, also moves the throwing arm back and forth frequently in short swings. Thus the points during the long swing at which targets are thrown, are irregularly, rather than regularly spaced apart.

The invention is particularly toward a target throwing device comprising a base, a support, and means for mounting the support on the base for swinging movement about an upright axis. A target throwing arm is rotatably mounted on the support. Drive means for provided for operating the target throwing arm to throw targets. Guide means are mounted on the base and extend in the general direction targets are to be thrown. Eccentric drive means are connected between the guide means and the support for eccentrically swinging the support about the upright axis.

The eccentric drive means includes a first eccentric drive connection between the support and the guide means for swinging the support back and forth in long swings, and a second eccentric drive connection within the first drive connection for superimposing an eccentric series of short back and forth swings on the support during each long swing.

The invention will now be described in detail having reference to the accompanying drawings in which.

Figure 1:
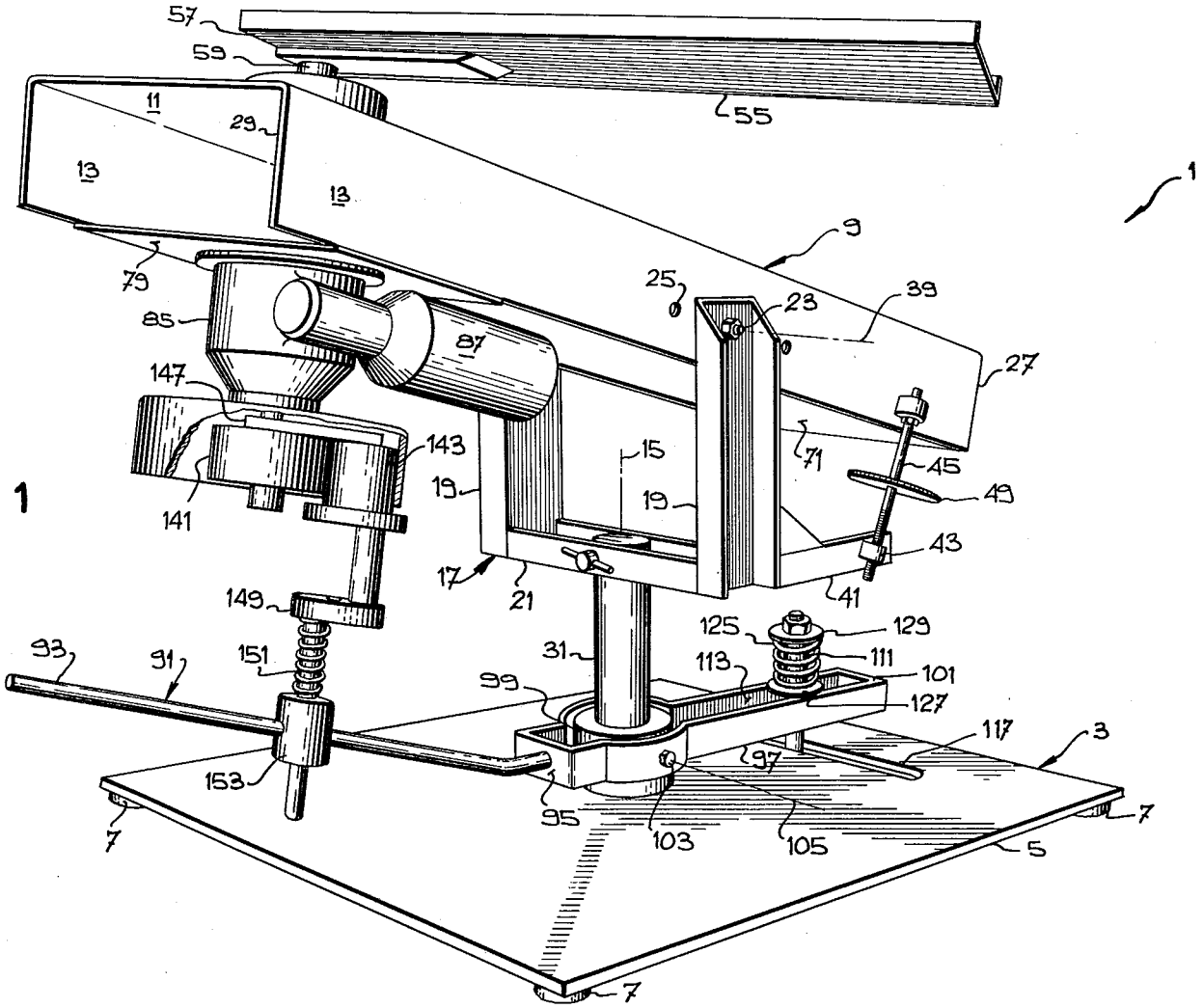
FIG. 1 is a perspective view of the target throwing device.
Figure 2:
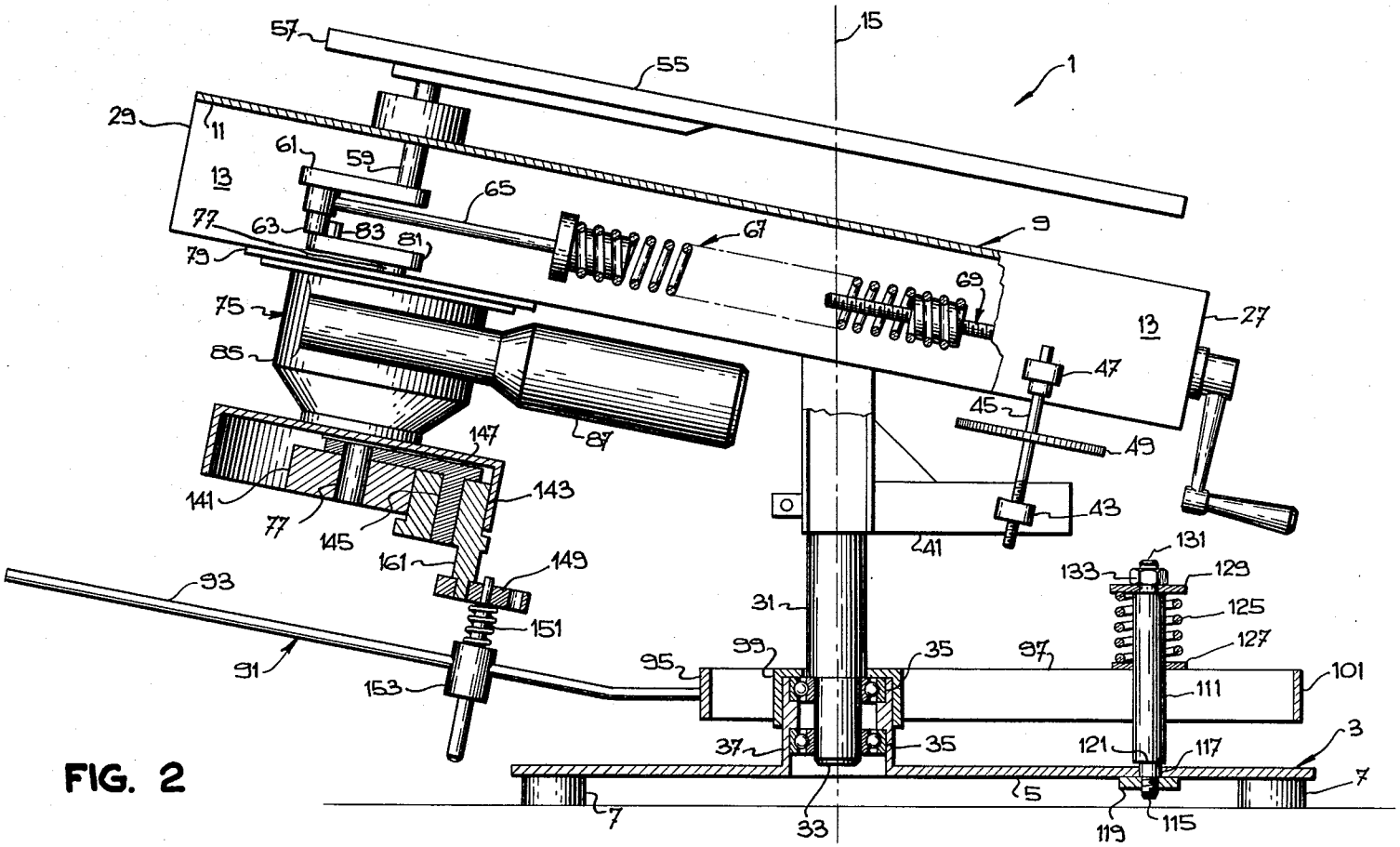
FIG. 2 is a side elevation view of the device, in partial section.
Figure 3C:
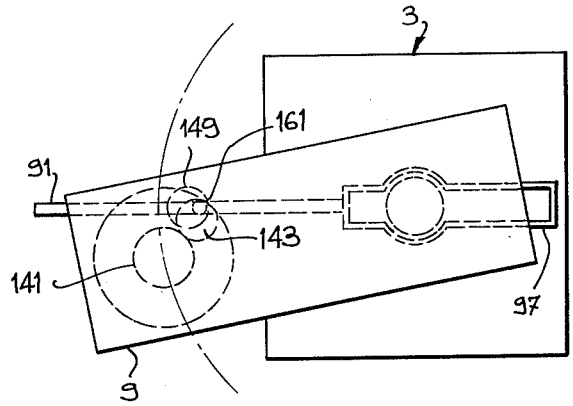
Figure 3B:
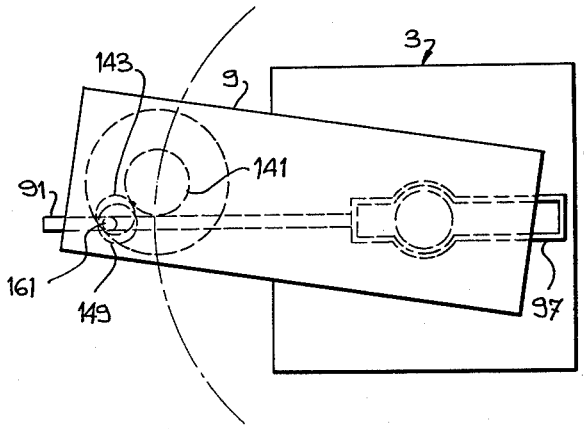
Figure 3A:
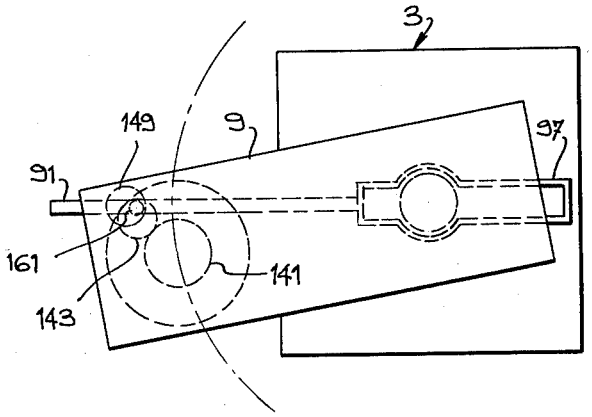

FIGS. *3a, 3b* and *3c* are schematic plan views of the deice showing its operation.

The target throwing device 1 of the present invention has a flat base 3. The base 3 can comprise a rectangular plate 5 having a short leg 7 at each corner by way of which the device 1 is supported.

A support 9 is mounted on the base 3. The support 9 can comprise an inverted channel member having a top wall 11 and a pair of side walls 13 depending down from the top wall 11. The support 9 is mounted on the base 3 for swinging movement about an upright axis 15 by mounting means 17. The mounting means 17 can include a pair of spaced-apart upstanding arms 19 joined by a bottom cross-bar 21. The support is pivotably mounted between the the arms 19 by bolts 23 connecting the upper ends of the arms 19 to the sidewalls 13 of the support. The bolts 23 pass through one pair of a set of holes 25 in the sidewalls 13. The holes 25 are located nearer the back end 27 of the support than the front end 29 and provide for some lengthwise adjustment in mounting the support 9. A mounting shaft 31 extends down from the center of cross-bar 21. The lower end 33 of the shaft 31 is rotatably mounted in bearings 35 located within a boss 37. The boss 37 extends up from the central portion of base plate 5. The support 9 is thus free to swing about the upright axis 15 of mounting shaft 31 mounted in boss 37. The support 9 can also swing about a horizontal axis 39, intersecting the upright axis 15, on bolts 23.

Means are provided for limiting the swinging movement of the support 9 about the horizontal axis 39. These means comprise a support arm 41 extending rearwardly from cross-bar 21. A threaded nut 43 is fixed to the side of arm 41. The nut 43 is mounted to rotate about a horizontal axis on the side of arm 41. A long bolt 45 is rotatably fixed at one end to fastener means 47 on one side wall 13. The other end of the bolt 45 is threaded into nut 43. A disk 49 is fixed to the bolt 45 intermediate its ends. Rotation of the disk 49 in one direction or the other will raise or lower the support 9 about its horizontal mounting axis 39.

The support 9 carries a target throwing arm 55. The throwing arm 55 is rotatably mounted, near one end 57 on the support 9 by a shaft 59 which is mounted in the top wall 11 of the channel member. The shaft 59 is near the ront end 29 of the support. The throwing arm 55 extends generally parallel to the top wall 11. The bottom end of the shaft 59, within the channel member, carries a crank arm 61. A driven pin 63 projects down from the free end of the crank arm 61, offset from shaft 59. The pin 63 is connected, by a connecting rod 65 to the front end of a spring mechanism 67 mounted within the support. The spring mechanism 67 is attached at its rear end to a spring tension adjustment mechanism 69 which is mounted in a back wall 71 closing the rear end 27 of the support 9. The spring and adjustment mechanisms are well known.

Drive means 75 for operating the throwing arm 55 are mounted on the support 9. The drive means 75 include a drive shaft 77 rotatably mounted in a partial bottom wall 79 of the support 9. The drive shaft 77 is aligned with throwing arm shaft 59. The upper end of the drive shaft 77 carries a crank arm 81. The crank arm 81 has a drive pin 83 projecting up from its free end. The drive shaft 77 extends down from support 9 and through a gear housing 85. A motor 87 is mounted on the gear housing 85. The motor 87 drives gear means (not shown) within the housing 85 which rotate drive shaft 77. Rotation of drive shaft 77 causes drive pin 83 on crank arm 81 to pick up driven pin 63 of the crank arm 61 carried by the throwing arm shaft 59. Partial rotation of pin 63 loads the spring mechanism 67 via connecting rod 65, and when drive pin 83 no longer rotates driven pin 63 the loaded spring mechanism 67 rapidly returns driven pin 63 to its original position, thereby quickly swinging the throwing arm 55 to fling a target (not shown) loaded thereon.

The construction described above, or variations of it, is pretty well standard for many target throwers. The device 1 is the present invention includes guide means 19. These guide means 91 are mounted on the base 3 and extend in the general direction in which the targets are to be thrown. The guide means 19 comprises a guide rod 93 projecting from the front end 95 of a bracket 97. The guide rod 93 is generally parallel to support 9. The bracket 97 extends about a collar 99 intermediate its front end 95 and rear end 101, and is pivotably mounted thereto by a pair of opposed bolts 103. The collar 99 is rotatably mounted on the boss 37. Thus the bracket 97 can rotate about the upright axis 15 of the support shaft 31 and can also swing about a horizontal axis 105 provided by bolts 103 which axis intersects the upright axis 15.

Means are provided for locking the bracket 97 against swinging movement about the upright axis 15. The locking means includes a pin 111 projecting through a longitudinal-extending slot 113 in bracket 97, rearwardly of collar 99. The lower end 115 of pin 111 passes through a slot 117 in base 5. Slot 117 extends generally transverse to slot 113. The lower end 115 of pin 111 is threaded and a lock nut 119 is threaded on the pin 111 from the underside of base 3. When nut 119 is tightened, pin 111 is locked against movement in slot 117 between a shoulder 121 and nut 119. Thus the guide means 91 is locked against swinging movement. Its general aiming direction however can be easily adjusted by loosening nut 119, swinging the bracket 97 in either direction while pin 111 slides in both slot 117 and slot 113, and then tightening the nut 119.

The pin 111 projects up from the bracket 97. A compression spring 125 is mounted on pin 111 above bracket 97 between a first washer 127 loosely mounted on pin 111 on the top of bracket 97, and a second washer 129 fixed to the top threaded end 131 of pin 111 by a nut 133. The spring mounting arrangement allows the guide means 19 to have limited pivotal movement about the horizontal axis 105.

In accordance with the present invention, means are provided for eccentrially swinging the support 9 back and forth about the vertical axis 15 while the throwing arm 55 is flinging targets. These eccentric swinging means include a first eccentric drive connection having a sun gear 141 fixed to the bottom end of drive shaft 77. A planetary gear 143 is also provided, rotatably mounted on an axle 145. The arm 145 is mounted for rotation about drive shaft 77 by a support arm 147. The planetary gear 143 is connected to one end of a crank arm 149 which is itself rotatably mounted on a pin 151 projecting up from a sliding block 153. The crank arm is rotatably connected to the crank pin 149 at more than one location to vary the throw of the crank arm 149. The sliding block 153 is slidably mounted on the guide rod 93 of guide means 91.

As the sun gear 141 is rotated, it moves the planetary gear 143 about its circumference. The planetary gear 143, through crank arm 149, pushes to and from the sliding block 153 thus swinging the support 9 in long swings back and forth past the guide rod 93 about the upright axis 15. The amount of swing is determined by the length of the crank arm 149 and its distance from the upright axis. The effective length of the arm 149 can be varied to provide different amounts of swing of the support arm.

The eccentric swinging means also include a second eccentric drive connection within the first drive connection. The second drive connection comprises an eccentric pin 161, offset from the planetary gear axle 145, and depending down from planetary gear 143. This pin 161 makes the gear connection to the crank arm 149. Thus as gear 143 rotates about the sun gear 141 to provide swinging movement, it is at the same time eccentrically moving pin 161 to rapidly move the support 9 back and forth in short swings in eccentric motion during each slow, long swing. Thus a very unpredicatable motion is imparted to the support thereby providing better target shooting.

We claim:

1. A target throwing device comprising a base; a support; means for mounting the support on the base for swinging movement about an upright axis; a target throwing arm rotatably mounted on a support; guide means connected to the support and mounted on the base and extending in the general direction the targets are to be thrown and adapted to transmit oscillatory motion to the support; drive means for operating the target throwing arm to throw targets; and eccentric drive means connecting the guide means and the support for eccentrically swinging the support about the upright axis said eccentric drive means includes a first eccentric means connection between the support and the guide means for swinging the support back and forth in long swings, and a second eccentric drive means connected within the first eccentric drive connection and operative in response to movement of the first eccentric drive means for superimposing an eccentric series of short back and forth swings on the support during each long swing said second eccentric drive means transmitting eccentric motion to the support through a member that is moveable with respect to the guide means.

2. A target throwing device as claimed in claim 1 wherein the first eccentric drive connection includes a drive shaft rotatably mounted in the support, the drive shaft extending perpendicularly down from the support and spaced from the support mounting means, a sun gear fixed to the bottom part of the drive shaft, a planetary gear rotatably mounted on an axle, the axle mounted to rotate about the drive shaft while the planetary gear is driven by the sun gear, a slide member slidably mounted on the guide means, and a crank arm rotatably connected between the slide member and the sun gear.

3. A target throwing device as claimed in claim 2 wherein the second eccentric drive connection comprises a crank pin depending from the planetary gear, the crank pin offset from the axle of the planetary gear and rotatably connected to the crank arm.

4. A target throwing device as claimed in claim 3 wherein the crank arm can be rotatably connected to the crank pin at more than one location to vary the throw of the crank arm.

5. A target throwing device as claimed in claim 2 wherein the drive shaft forms part of the drive means for operating the target throwing device.

6. A target throwing device as claimed in claim 1 including means for mounting the guide means for rotation about the upright axis so its direction can be adjusted, and locking means for locking the guide means in its desired direction.

7. A target throwing device as claimed in claim 6 including pivot means for mounting the guide means for rotation about a generally horizontal axis which intersects the upright axis.

8. A target throwing device as claimed in claim 7 including pivot means for mounting the support on its mounting means for rotation about a horizontal axis which intersects the upright axis.

* * * * *